US010478738B1

(12) United States Patent
Wong

(10) Patent No.: US 10,478,738 B1
(45) Date of Patent: Nov. 19, 2019

(54) TOY DUCK

(71) Applicant: On The Spot Manufacturing Limited, San Po Kong, Kowloon (HK)

(72) Inventor: Kam Kei Raymond Wong, Kowloon (HK)

(73) Assignee: ON THE SPOT MANUFACTURING LIMITED, San Po Kong, Kowloon (HK)

( * ) Notice: Subject to any disclaimer, the term of this patent is extended or adjusted under 35 U.S.C. 154(b) by 0 days.

(21) Appl. No.: 16/186,223

(22) Filed: Nov. 9, 2018

(51) Int. Cl.
*A63H 23/00* (2006.01)
*A63H 23/10* (2006.01)

(52) U.S. Cl.
CPC ..... *A63H 23/10* (2013.01)

(58) Field of Classification Search
CPC ..... A63H 23/10
USPC ..... 446/153–158
See application file for complete search history.

(56) References Cited

U.S. PATENT DOCUMENTS

| | | | | |
|---|---|---|---|---|
| D416,083 | S * | 11/1999 | Altman | D23/381 |
| 7,347,759 | B2 * | 3/2008 | Williams, Sr. | A63H 13/02 43/26.2 |
| 2011/0014845 | A1 * | 1/2011 | Monahan | A63H 23/10 446/153 |
| 2012/0214381 | A1 * | 8/2012 | Rickenbach | A63H 23/10 446/153 |

* cited by examiner

*Primary Examiner* — Nini F Legesse
(74) *Attorney, Agent, or Firm* — Muncy, Geissler, Olds & Lowe, P.C.

(57) ABSTRACT

The present discloses a toy duck comprising a main body shaped as a duck; a nozzle disposed on the main body for spraying water in case the main body is pressed externally; a hole at the bottom of the main body for receiving a piston assembly; and a piston assembly disposed in the hole for sealing the main body so as to prevent water from leaking from the main body, and allowing complete drainage of water in the toy duck when the toy duck is disposed on a horizontal panel to keep the duck toy clean and hygienic. The internal cavity of the main body will not contain water any more due to the piston assembly, and can be kept clean and hygienic, which is not suitable for generation and growth of bacteria therein. The new toy duck will not cause harm to health of the children.

13 Claims, 5 Drawing Sheets

TOY DUCK

TECHNICAL FIELD OF THE INVENTION

The present invention relates to the field of toy, and more particularly, to a toy duck which can be fully dried and keep clean and hygienic.

BACKGROUND OF THE INVENTION

Toys are very popular to children nowadays, and a plenty of toys for bath use commercially available, such as a rubber yellow duck, have a function of spraying water. The yellow duck is made of plastic having a cavity for containing water therein, and a small opening at the mouth for spraying water. When the duck is pressed externally, air in the cavity can be released, resulting in a pressure difference between the internal cavity and the external duck. And water can be flowed into the cavity when the said duck is disposed in water due the pressure difference, while the water can be sprayed from the small opening when the duck full of water is pressed externally. However, there in only one opening at the mouth for draining water, water containing in the cavity is hardly drained completely, leading to water being often remained in the cavity. On one hand, water for bathing contain bacterial due to children's body fluid and soap; on the other hand, the yellow duck is made of plastic, which provide nutrients required for growth of microorganisms such as bacteria. When water with bacteria contain in the duck, bacteria can be generated and grew therein, which may be harmful to the health of children. Obviously, the toy duck in prior art cannot satisfy the health requirement, which is need to be changed structurally to reduce harms.

Therefore, it is very urgent to improve the existing yellow duck commercially available so as to obtain a toy duck without remaining water in the cavity in the duck after it is drained effectively by hand and thus effectively reduce the harms to the children extensively.

SUMMARY OF THE INVENTION

The object of the present invention is to provide a novel toy duck, which is structurally improved to drain water containing in the internal cavity, and thus reduce danger and harms to the health of children who play this toy during the period of bathing.

To achieve the above object, the following technical solutions are adopted:

a toy duck comprising:

a main body having a cavity for containing water, which is made of plastic and shaped as a duck;

a nozzle disposed on the main body for spraying water in case the main body is pressed externally;

a hole at the bottom of the main body for receiving a piston assembly; and a piston assembly disposed in the hole for sealing the main body so as to prevent water from leaking from the main body, and allowing complete drainage of water in the cavity when the toy duck is disposed on a horizontal panel to keep the duck toy clean and hygienic.

Preferably, according to the toy duck of the present invention, the piston assembly comprises: a piston composed of a circular top and a cylindrical end; a base which is provided a central hole and plurality of receiving grooves; and a circular dome comprises a top and side wall, which is provided a hole at the top and a plurality of gaps at the side wall; and wherein the circular dome is combined with the base, and the piston is movably disposed in a space created by the circular dome and the base.

Preferably, according to the toy duck of the present invention, a top end of the piston is inserted into a bottom of the main body of the toy duck by the hole of the base.

Preferably, according to one embodiment of the toy duck of the present invention, the piston is made of plastic or rubber. According to another embodiment of the toy duck of the present invention, the hole is a circular hole, and the central hole is a circular hole.

Preferably, according to one embodiment of the toy duck of the present invention, the piston is movable along the side wall of the circular dome. According to another embodiment of the toy duck of the present invention, three gaps are arranged on the side wall of the circular dome.

According to another embodiment of the toy duck of the present invention, the piston assembly is assembled on the main body of the toy duck, water is flowed into the cavity of the main body from the hole and gaps of the circular dome and the central hole of the base.

According to another embodiment of the toy duck of the present invention, the toy duck full of water is pressed externally, the piston is pushed downwardly by water pressure so that the central hole of the base is blocked by the piston to prevent water from leaking from the main body, other than the nozzle.

According to another embodiment of the toy duck of the present invention, the toy duck full of water is disposed on a horizontal panel, the piston is pushed upwardly to open the hole of the base and allow water flowing from the main body by the increasing pressure of the horizontal panel because the piston is protruded from the bottom of the toy duck.

Further, the base is provided with a plurality of foot supports at the bottom thereof for supporting the piston assembly on a horizontal panel so that water can be flown smoothly from the main body quickly when there is a need to drain off water. Preferably, the base is provided with three foot supports.

It is an advantage of the present invention that the toy duck of the present invention utilizes a special piston assembly at the bottom of the duck to guide water to flow out from the cavity of the duck, which the internal space of the duck can be completely dried so as to reduce generation and growth of bacteria. On the other hand, the piston assembly can be used as a sealing member engaged with the main body of the toy duck to block the hole of the bottom of the toy duck for prevent water from leaking from the cavity due to the pressure difference between the internal cavity and the atmosphere. Hence the internal cavity of the main body will not contain water any more, and can be kept clean and hygienic, which is not suitable for generation and growth of bacteria therein. The new toy duck will not cause harm to health of the children.

Moreover, the special piston assembly has a simple structure which is made of plastic or rubber with cost efficient. Thus this toy duck can be promoted and used widely.

These and other objectives of the present invention will no doubt become obvious to those of ordinary skill in the art after reading the following detailed description of the preferred embodiment, which is illustrated in the various figures and drawings.

BRIEF DESCRIPTION OF THE DRAWINGS

For a more complete understanding of the present invention, reference is made to the following detailed description of various exemplary embodiments thereof, considered in conjunction with the accompanying drawings, in which.

DETAILED DESCRIPTION OF THE INVENTION

Figure 1:
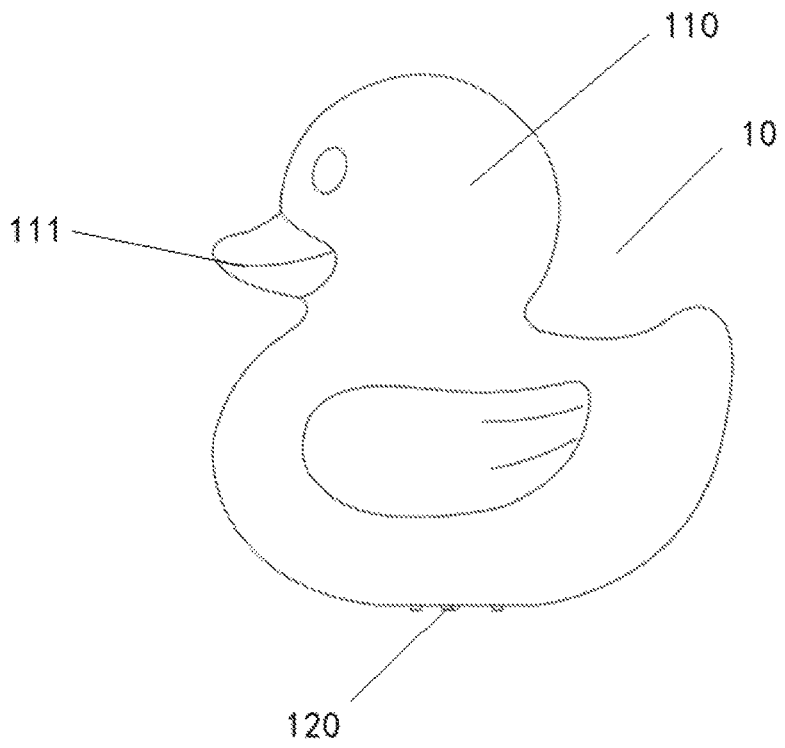
FIG. 1 is a schematic view of the toy duck of the present invention, in which the piston assembly is attached to the main body.
Figure 2:
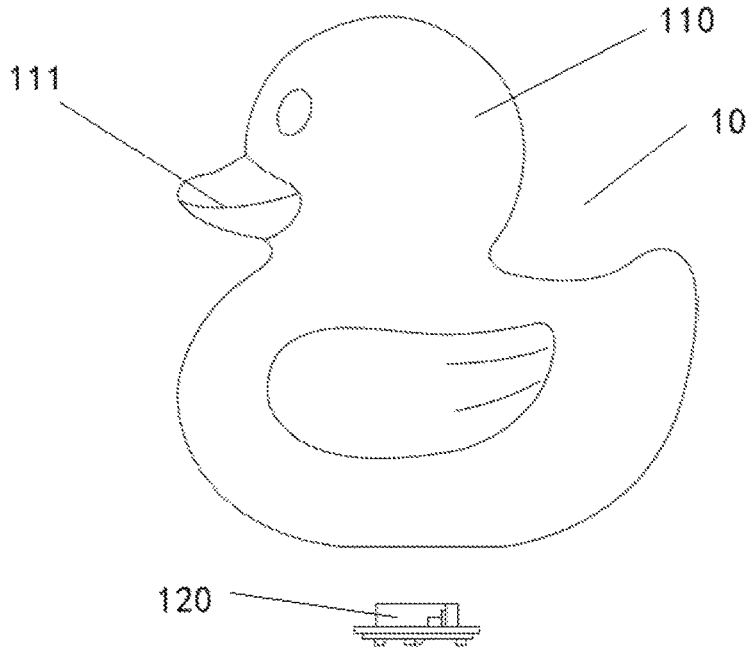
FIG. 2 is a schematic view of the toy duck of the present invention, in which the piston assembly is detached from the main body.
Figure 6:
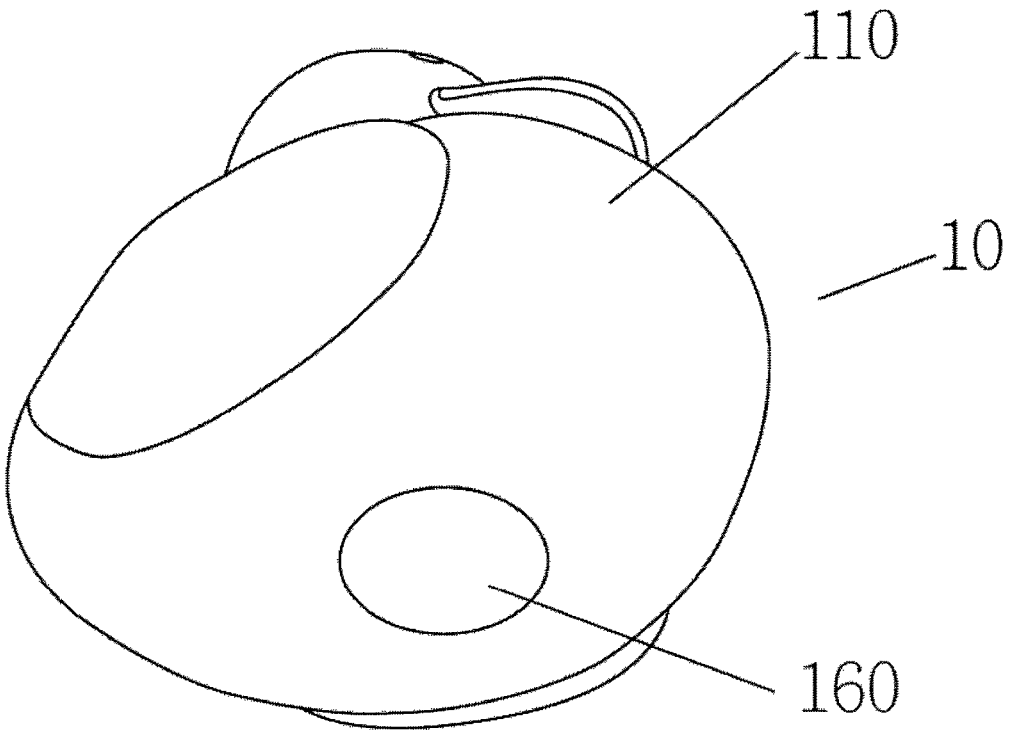
FIG. 6 is a bottom perspective view of the toy duck of the present invention, in which the piston assembly is detached from the main body.
Figure 7:
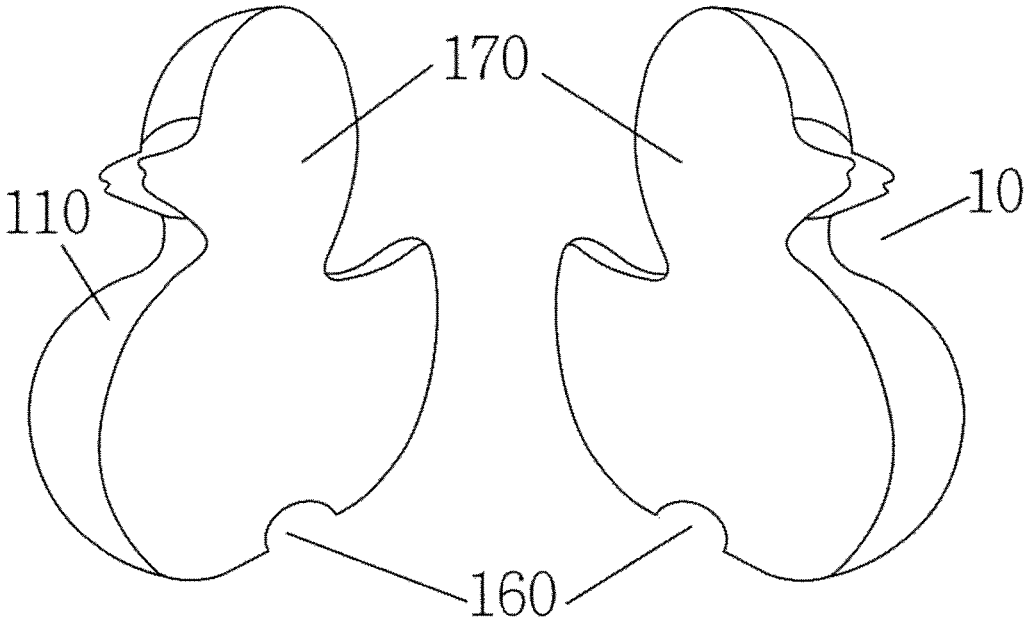
FIG. 7 is a side prospective sectional view of the toy duck of the present invention, in which the piston assembly is detached from the main body.

Referring to FIG. 1 and FIG. 2, in accordance with one embodiment of the present invention, a toy duck 10 is disclosed, which includes a main body 110 having a nozzle 111 in a mouth and a piston assembly 120. The piston assembly 120 is configured to attach or detach from the main body 110. The nozzle 111 is configured to spay water containing in a cavity of the main body 110. The main body 110 is made of plastic or rubber, which can be used in bathroom or other environment. Referring to FIG. 6 and FIG. 7, in accordance with one embodiment of the present invention, the toy duck 10 further includes a hole 160 at the bottom of the main body and a cavity 170 inside the main body of the toy duck.

Figure 3:
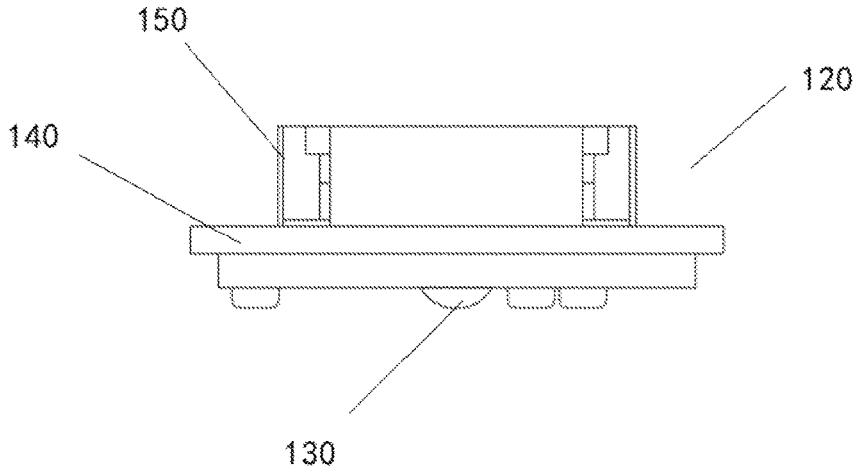
FIG. 3 is a schematic view of the piston assembly of the toy duck of the present invention.
Figure 4:
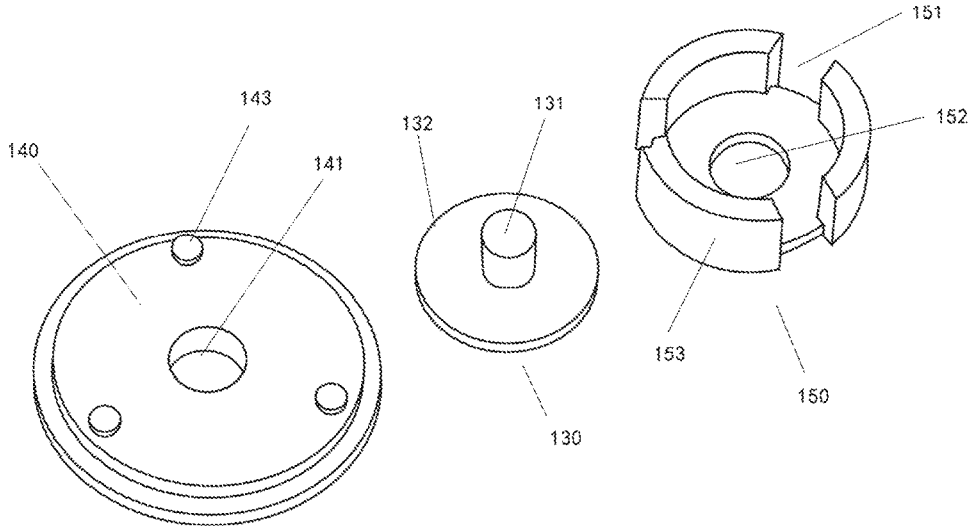
FIG. 4 is an exploded view of the piston assembly of the toy duck of the present invention.
Figure 5:
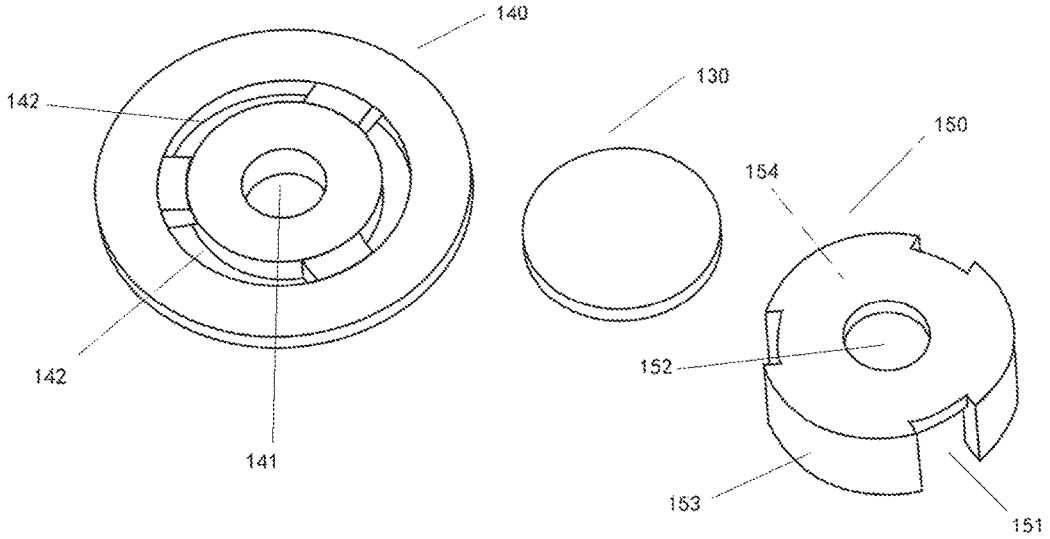
FIG. 5 is another exploded view of the piston assembly of FIG. 4.

Referring to FIG. 3-FIG. 5, according to one embodiment of the present invention, the piston assembly 120 includes the following three members: a piston 130 composed of a circular top 132 and a cylindrical end 131; a base 140 which is provided a central hole 141 and a plurality of foot supports 143; and a circular dome 150 comprises a top 154 and a side wall 153, which is provided a hole 152 at the top 154 and a plurality of gaps 151 at the side wall 153.

The circular dome 150 is combined with the base 140, and the piston 130 is movably disposed between the circular dome 150 and the base 140 to form the piston assembly 120, in which the cylindrical end 131 is inserted into the central hole 141 so as to connect to the main body 110 of the toy duck 10.

Obviously, the central hole 141 is also a circular hole, so as to fit with the cylindrical end 131 of the piston 130. Preferably, after the piston 130 is fully inserted into the circular dome 150, the circular top 132 can be completely abutted against the internal bottom of the circular dome 150 and can block the central hole 141 of the base to prevent water from flowing.

The base 140 has receiving grooves 142 to receive the walls of the circular dome 150 which are spaced by gaps 151. In one embodiment, three grooves 142 are arranged on the base to receive the walls correspondingly.

Further, the foot supports 143 at the bottom of the base 140 is intended for supporting the piston assembly on a horizontal panel. It can also withstand the main body 110 of the toy duck 10 to leave a space for water flowing on the panel, so that water can be flown smoothly from the main body 110 quickly when there is a need to drain off water. Otherwise, if no foot supports 143 are provided, water cannot be drained since no space is created between the toy duck 10 and the panel. Preferably, the base 140 is provided with three foot supports 143 at its bottom.

According to one embodiment of the toy duck 10 of the present invention, the piston 130 is made of plastic or rubber, for example PE, PP or EVA.

After the piston 130 is assembled, the piston 130 can be movable along the side wall 153 of the circular dome 150, and the circular top 132 can be completely abutted against the internal bottom of the circular dome 150 for blocking the central hole 141 of the base. According to another embodiment of the toy duck of the present invention, three gaps 151 are arranged on the side wall of the circular dome 150.

According to the present invention, the piston assembly 120 is assembled on the main body 110 of the toy duck 10, water can be flowed into the cavity of the main body 110 from the hole 152 and gaps 151 of the circular dome 150. When the toy duck full of water is pressed externally, the piston 130 is pushed downwardly by water pressure so that the central hole of the base is blocked by the circular top and the cylindrical end of the piston 130 respectively to prevent water from leaking from the main body 110, other than the nozzle.

According to another embodiment of the toy duck of the present invention, when the toy duck 10 full of water is disposed on a horizontal panel, the piston 130 can be pushed upwardly to open the hole of the base 140 and allow water flowing from the main body 110 by the increasing pressure of the horizontal panel because the piston 130 is protruded from the bottom of the toy duck 10.

In light of the above, because the toy duck of the present invention utilizes a special piston assembly at the bottom of the duck to guide water to flow out from the cavity of the duck, the internal space of the duck can be completely dried so as to reduce generation and growth of bacteria. On the other hand, the piston assembly can be used as a sealing member engaged with the main body of the toy duck to block the hole of the bottom of the toy duck for prevent water from leaking from the cavity due to the pressure difference between the internal cavity and the atmosphere. Hence the internal cavity of the main body will not contain water any more, and can be kept clean and hygienic, which is not suitable for generation and growth of bacteria therein. The new toy duck 10 will not cause harm to health of the children.

Moreover, the special piston assembly has a simple structure which is made of plastic or rubber with cost efficient. Thus this toy duck can be promoted widely.

The invention has been described hereinabove using specific examples; however, it will be understood by those skilled in the art that various alternatives may be used and equivalents may be substituted for elements or steps described herein, without deviating from the scope of the invention. Modifications may be provided to adapt the invention to a particular situation or to particular needs without departing from the scope of the invention. It is intended that the invention not be limited to the particular implementation described herein, but that the claims be given their broadest interpretation to cover all embodiments, literal or equivalent, covered thereby. Accordingly, the above disclosure should be construed as limited only by the metes and bounds of the appended claims.

The invention claimed is:

1. A toy duck comprising:

a main body having a cavity for containing water, which is made of plastic and shaped as a duck;

a nozzle disposed on the main body for spraying water in case the main body is pressed externally;

a hole at the bottom of the main body for receiving a piston assembly; and a piston assembly disposed in the hole for sealing the main body so as to prevent water from leaking from the main body, and allowing complete drainage of water from the cavity when the toy duck is disposed on a horizontal panel to keep the duck toy clean and hygienic.

2. The toy duck according to claim 1, wherein the piston assembly comprises:

a piston composed of a circular top and a cylindrical end;

a base which is provided a central hole and a plurality of receiving grooves; and a circular dome comprises a top and a side wall, which is provided a hole at the top and a plurality of gaps at the side wall;

and wherein the circular dome is combined with the base, and the piston is movably disposed in a space created by the circular dome and the base.

3. The toy duck according to claim 2, wherein a top end of the piston is inserted into a bottom of the main body of the toy duck by the hole of the base.

4. The toy duck according to claim 2, wherein the piston is made of plastic or rubber.

5. The toy duck according to claim 2, wherein the central hole is a circular hole.

6. The toy duck according to claim 2, wherein the piston is movable along the side wall of the circular dome.

7. The toy duck according to claim 2, wherein three gaps are arranged on the side wall of the circular dome.

8. The toy duck according to claim 2, wherein the piston assembly is assembled on the main body of the toy duck, water is flowed into the cavity of the main body from the hole and gaps of the circular dome and the central hole of the base.

9. The toy duck according to claim 8, wherein the toy duck full of water is pressed externally, the piston is pushed downwardly by water pressure so that the central hole of the base is blocked by the piston to prevent water from leaking from the main body, other than the nozzle.

10. The toy duck according to claim 8, wherein the toy duck full of water is disposed on a horizontal panel, the piston is pushed upwardly to open the hole of the base and allow water flowing from the main body by the increasing pressure of the horizontal panel because the piston is protruded from the bottom of the toy duck.

11. The toy duck according to claim 1, wherein the hole is a circular hole.

12. The toy duck according to claim 1, wherein the base is provided with a plurality of foot supports at the bottom thereof for supporting the piston assembly on a horizontal panel so that water can be flown smoothly from the main body quickly when there is a need to drain off water.

13. The toy duck according to claim 12, wherein the base is provided with three foot supports.

* * * * *